United States Patent [19]

Zimmerman, Jr. et al.

[11] Patent Number: 4,470,782

[45] Date of Patent: Sep. 11, 1984

[54] APPARATUS FOR PRODUCING ORTHOTICS

[76] Inventors: Robert L. Zimmerman, Jr., 11 Maple St., Lake Placid, N.Y. 12946; Elliot G. Swan, 264 International House, 1414 E. 59th St., Chicago, Ill. 60637

[21] Appl. No.: 489,308

[22] Filed: Apr. 28, 1983

[51] Int. Cl.[3] ..... B29C 1/00; B29F 1/00

[52] U.S. Cl. ..... 425/2; 264/223; 425/542

[58] Field of Search ..... 425/2, 542; 264/223

[56] References Cited

U.S. PATENT DOCUMENTS

| | | | |
|---|---|---|---|
| 2,216,533 | 10/1940 | Kaplan | 425/2 |
| 2,565,758 | 8/1951 | Covino | 264/223 |
| 2,581,489 | 1/1952 | Kilham | 425/2 |
| 2,856,633 | 10/1958 | Murray | 425/2 |
| 3,444,586 | 5/1969 | Dubner | 425/2 |

*Primary Examiner*—Willard E. Hoag

*Attorney, Agent, or Firm*—Jordan B. Bierman; Linda Bierman

[57] ABSTRACT

An apparatus for producing custom orthotics includes a boundary wall encompassing a substrate pad and an overlying elastic skin to form an expandable interior chamber into which high density molding material is injected. A matrix of axially movable drive pins project through the pad and are urged upwardly into contact with the arch of the individual's foot to maintain the foot in properly aligned position during fabrication of the orthotic, the drive pins carrying a support bridge driven into conforming contact against the arch of the foot.

16 Claims, 7 Drawing Figures

APPARATUS FOR PRODUCING ORTHOTICS

BACKGROUND OF THE INVENTION

The present invention concerns an apparatus for producing custom-configured, precision orthotics.

It is widely recognized that many individuals stand—whether due to structural deficiencies of the feet or acquired bad posture or the like—in a manner which does not properly align the various bones of the feet and legs and accordingly causes physical discomfort ranging from minor back pains to severe disability. Orthotics compensate for the structural deficiencies of an individual's foot or one's manner of standing by dynamically aligning the foot with the lower leg and knee. Proper alignment dramatically reduces the incidence of injury to the feet, ankles, knees and lower back. For individuals suffering from pain in these areas, orthotics can provide a measure of relief. For others—especially serious amateur and professional atheletes—orthotics reduce the chance of injury while improving economy of motion.

Unlike simple arch supports, which underlie only the central portion of the foot sole, orthotics are full foot supports that can replace the insole of an article of footwear to achieve proper alignment of the ankle and knee. Typically underlying the entire sole of the foot, a properly configured orthotic rotates the foot into an anatomically correct and aligned position that cannot be achieved by a simple arch support. They are most useful and effective, of course, when custom-produced to conform to the unique surface undulations of a particular individual's foot sole.

Relatively primitive orthotics have been fashioned for many years through various relatively complex "hands-on" processes, including molding techniques and vacuum shaping. All require a great deal of time, and many opportunities exist for alignment and fabrication errors to enter the process and destroy the accuracy of the orthotic.

One well-known technique commonly practiced contemplates having the individual sit on an elevated table with feet dangling. The foot is then held in apparent alignment—by lining up, for example, the center of the top of the foot's arch with the center of the kneecap using a crosshair or reference line—and molding material is formed about the foot to create a mold. This mold is thereafter employed to produce the orthotic, often at a remote location, and the entire process can easily take several weeks. Thus, the mold is formed while the patient's foot is in a nonweight-bearing condition—i.e. while no load is being placed on the foot—and one cannot therefore be certain that in a normal weight-bearing state the foot's alignment will remain as desired. Since the orthotics are made from molds which are, in turn, formed from the individual's feet, additional errors frequently enter the production process such that the resulting orthotic often loses a great deal of its potential effectiveness in correcting the individual's foot alignment problems.

It is accordingly the desideratum of the present invention to provide an apparatus with which custom-configured orthotics can be readily and accurately produced while the foot is maintained in weight-bearing relation and without unnecessary delay in obtaining the final product.

It is a further object of the invention to provide such an apparatus in the use of which a custom orthotic is produced directly from the individual's foot and without intermediate molds or the like.

Other objects and features of the present invention will become apparent from the following detailed description when considered in connection with the accompanying drawings. It is to be understood, however, that the drawings are designed solely for purposes of illustration and not as a definition of the limits of the invention for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 3:
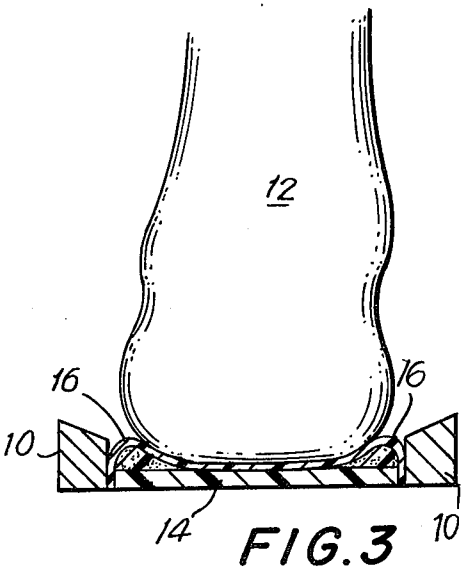
FIG. 3 is an end view of the diagrammatic illustration of FIG. 1.
Figure 1:
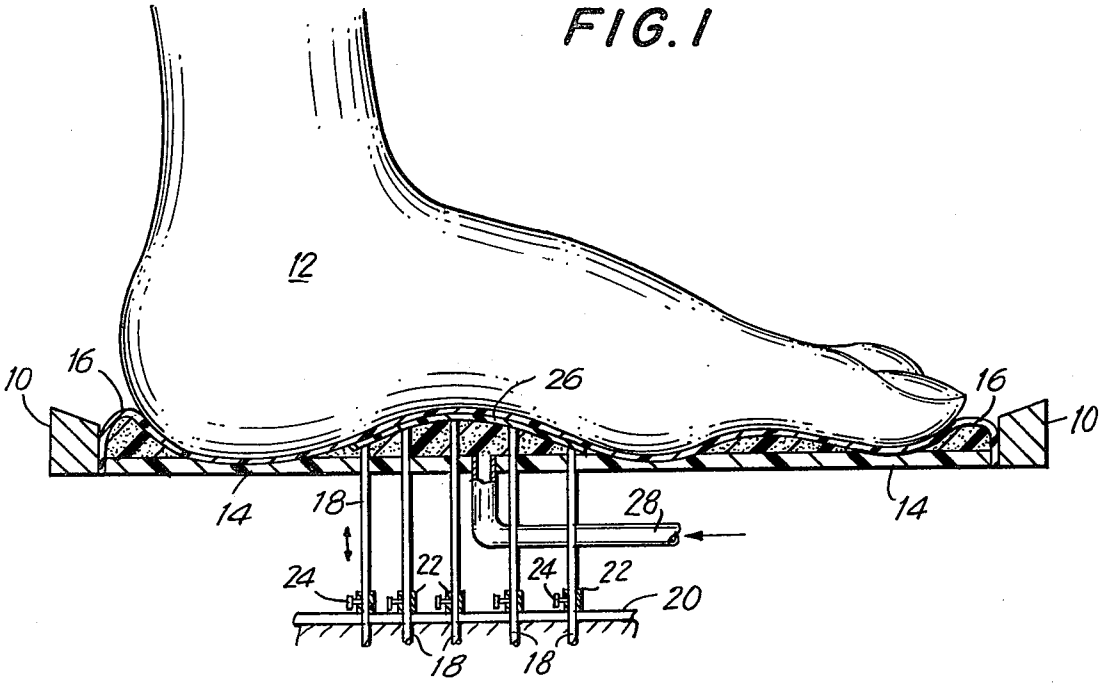
FIG. 1 is a diagrammatic side view, in section, illustrating the conceptual basis of the present invention.
Figure 2:
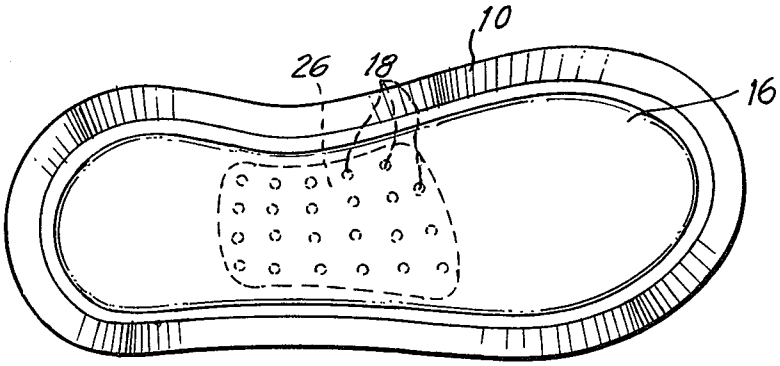
FIG. 2 is a plan view of the diagrammatic illustration of FIG. 1 with the individual's foot is removed.

The conceptual basis of the present invention is best understood by reference to FIGS. 1 to 3, which provide diagrammatic illustrations of the manner in which the various elements of the inventive apparatus cooperatively interact in the production of precision custom orthotics. A boundary wall 10 surrounds the area into which a standing individual's foot 12 is placed during the production process. It is preferred that the boundary wall substantially conform to the size of the foot to be received within its interior area, and in practice a plurality of walls 10 corresponding to a wide range of standard foot sizes might be made available to assure an appropriate match. Wall 10 serves several functions, among them to confine and bound the orthotic and to limit the outward flow of molding material, as will soon be evident, beyond its inwardly-disposed surface.

A slipper or substrate pad 14 fits within and peripherially extends at least throughout the entire interior area bounded by wall 10. Pad 14 will generally be formed of a foam or plastic material to impart cushion-like characteristics to the orthotic, of which pad 14 comprises and defines the bottom surface or wall, although it is within the contemplation of the invention that it be relatively hard or rigid where appropriate to the particular footwear receiving the orthotic. The upper wall of the orthotic, on the other hand, is formed by an elastic skin 16 that is held in place relative to substrate pad 14 by wall 10 under which its outer edges are confined. Thus, pad 14 and the elastic skin 16 define between them an expandable interior chamber or area into which moldable material is injected during formation of the orthotic; wall 10 sits atop and retains skin 16 and thereby additionally serves to ensure the integrity of the expandable interior chamber. In the event that pad 14 is larger in area than the interior bounds of wall 10, the latter can also be disposed atop the extraneous peripheral portions of pad 14 which can be trimmed away following completion of orthotic fabrication.

A plurality of elongated drive pins 18 project into the interior chamber between pad 14 and skin 16 through openings defined in the substrate pad. Drive pins 18 are spaced apart in a matrix-like arrangement and each is independently movable along the direction of its elongation and relative to a fixed member or surface 20. Although pins 18 can be provided throughout the entire area bounded by wall 10, it is intended that they be present at least in the area underlying the arch portion of the foot 12 for which an orthotic is to be fabricated.

As will hereinafter be understood, in use each drive pin 18 is upwardly moved or driven against the overlying sole of foot 12 to enable proper alignment of the foot to be maintained during the orthotic production process. For this purpose, the pins may be upwardly urged by a spring arrangement, or manually, or any other conventionally known method as appropriate or desired. In addition, means are provided for positionally fixing each drive pin at its particular desired final position against the foot sole. In FIG. 1, this is accomplished by the provision of a plurality of tubular collars 22, each encircling a portion of the shaft of one of the drive pins 18 and secured to fixed member 20. Each drive pin 18 is normally axially slidable through its corresponding collar 22; this slidability is, however, selectively preventable by tightening a screw 24 threaded or otherwise journalled through an opening in each collar 22 into contact with the respective drive pin 18.

Also disposed within the interior chamber defined between substrate pad 14 and elastic skin 16, and located in the area below the arch of foot 12, is a deformable support bridge 26. The placement of bridge 26 is such that as pins 18 are axially moved or driven toward the foot sole their heads are brought into contact with the bridge which is correspondingly driven against the arch of the foot. As a consequence of the relatively pliable construction of bridge 26 the same comes to define a continuous surface closely conforming to the configuration of that portion of the foot sole against which it is driven—i.e. the arch of the foot as seen in FIG. 1. This arrangement is perhaps best understood by reference to FIG. 2, which illustrates in plan view the relative placement of support bridge 26 with respect to wall 10 and the manner in which it overlies drive pins 18 which urge the bridge into closely conforming contact with the arch of foot 12 through, of course, elastic skin 16.

Support bridge 26 may be formed of a wide variety of materials, including leather, polyurethane and polyethylene. While the first of these materials provides perhaps a maximum degree of pliability—as might, for example, be desired where the orthotic is to be employed in athletic footwear—the latter two materials have the advantage of increased pliability when heated (as during fabrication of the orthotic) and subsequent relative rigidity and corresponding shape retention when cooled. It should also be understood that the provision of support bridge 26 in the fabricated orthotic is not essential; the inventive apparatus can be utilized to produce a precision orthotic without bridge 26. Moreover, the provision of a second support bridge—under the heel or in any other location beneath the sole of the foot—is also within the contemplation of the invention.

An injection port 28 communicates with the interior chamber defined between substrate pad 14 and elastic skin 16 through an aperture in pad 14. It is through port 28 that molding material is injected into the chamber in fabricating the orthotic. Although only a single port 28 is shown in FIG. 1, it is preferred for assuring an efficient and even distribution of the molding material that several such ports be provided as, by way of example, in the areas underlying the heel, arch and toe portions of foot 12.

As indicated, the molding material is injected into the interior of the orthotic being fabricated through port 28. The molding material should be such as to be sufficiently free flowing at relatively low injection pressure when heated to an elevated temperature that is not, however, so high as to burn or cause discomfort to the individual for whom the orthotic is being produced. As such, a high density closed-cell foam may be mixed with a polymer just prior to injection, whereby the polymer will cause the mixture to set and solidify in relatively rapid fashion.

The procedure by which the orthotic is produced should now be evident. The apparatus is initially assembled by choosing the appropriately-sized boundary wall 10, and positioning substrate pad 14 and elastic skin 16 in the manner illustrated in FIGS. 1 to 3. If desired, an arch support bridge 26 may be positioned—prior to overlying the same with elastic skin 16—over the heads of drive pins 18 which, incidentally, can initially be disposed in fully lowered position so as not to project above or through pad 14. The individual being fitted then stands on the apparatus, placing his foot within the confines of wall 10 as shown in FIG. 1. It is important to emphasize and repeat that the orthotic fabrication process takes place while the individual remains standing; in this manner, the weight-bearing relationship of the bones is utilized to define and assure the proper supporting relationship of the resulting orthotic.

As drive pins 18 are upwardly urged to drive support bridge 26 against the sole of foot 12, the foot is properly positioned by aligning the center of the top of the arch of the foot with the center of the kneecap. For this purpose, the invention contemplates the provision of a pivotable centering wand or plumb bob (not shown) with which proper alignment can be verified, although other procedures and apparatus might also be employed.

When so aligned, the upwardly urged drive pins 18 are locked in position utilizing set screws 24 and the heated molding material is injected into port 28. Once the molding material skins over—i.e. solidifies along its surface (which will take only minutes, the precise time being dependent upon the particular molding material utilized)—the individual may step off the apparatus while the material completes its curing. The invention contemplates complete curing in under half an hour from initial injection of the molding material.

In addition to being associated with somewhat different curing periods, it should be understood that the particular injection molding material used in fabricating the orthotic can offer varied degrees of elasticity or hardness as desired. Thus, an orthotic for use in normal walking shoes might be formed of a relatively hard material (when cured), while material for use in sneakers or running shoes would be relatively elastic and deformable for that purpose.

It should also be understood that the molding material injected into the chamber defined between pad 14 and elastic skin 16 to fill in the voids or open areas under the individual's foot sole will generally create discreet islands of material rather than a continuous elevated surface. Pad 14 accordingly provides a substrate to which isolated islands of material can adhere and remain positionally fixed with respect to the individual's foot. The provision of more than a single injection port 28 facilitates the creation of such discreet islands by ensuring that the molding material is in fact properly distributed throughout the interior chamber defined between pad 14 and elastic skin 16.

It should now be recognized and appreciated that the present invention provides the ability to produce a custom orthotic for an individual quickly, efficiently and precisely directly from the foot while it is maintained in its normal, properly aligned weight-bearing condition. Alignment or molding errors that might otherwise enter the production process can therefore be significantly minimized or effectively eliminated.

Figure 6:
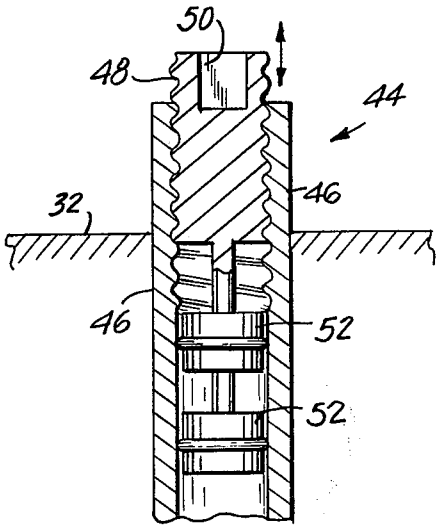
FIG. 6 is an enlarged sectional view of a controller of the apparatus of FIG. 4.
Figure 4:
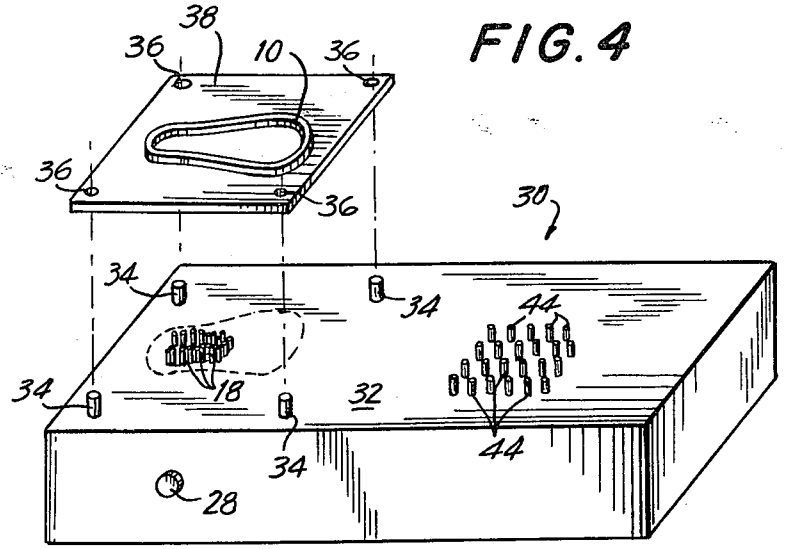
FIG. 4 is an elevated prospective view of an apparatus for producing orthotics in accordance with the teachings of the invention.

FIGS. 4 through 6 depict a practical implementation of the invention heretofore described. The orthotic fabricating apparatus 30 seen in FIG. 4 is a substantially self-contained unit constructed about a platform or foot-supporting surface or table 32. Drive pins 18 are seen projecting upwardly through platform 32 and are clustered in the area over which the arch of the foot is placed during orthotic fabrication. In order to accommodate a wide range of foot sizes, a sufficiently large matrix of drive pins 18 should be provided; an $8\times10$ matrix of pins has been found to be generally sufficient. Those pins 18 that are unnecessary and/or project beyond the interior bounds of the wall 10 being used can be locked in position flush with or below the foot supporting surface of table 32.

Table 32 is additionally fitted with upwardly projecting locator posts 34 for receipt in corresponding apertures 36 defined in a plate 38. Plate 38 carries an integral boundary wall 10 thereon for placement over and about drive pins 18 on platform 32. It is contemplated that a user of apparatus 30 will have a plurality of plates 38, each supporting a different size boundary wall 10 so that the wall utilized will appropriately conform to the individual's foot. The area within and surrounded by boundary wall 10 is cut out from plate 38 to permit drive pins 18 to project upwardly through the cutout when plate 38 is operatively fitted atop platform 32.

Figure 5B:
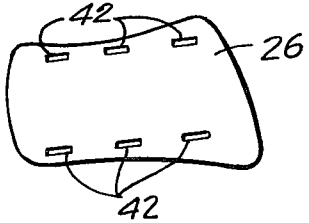
FIGS. 5A and 5B are enlarged details of cooperating engagement structures on the drive pins and support bridge of the apparatus of FIG. 4.
Figure 5A:
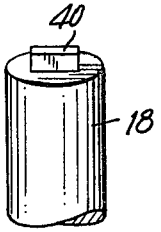

In order to assure and maintain proper relative alignment and positioning of support bridge 26 with respect to drive pins 18, each may be fitted with cooperating engagement means. One manner of implementing mutual engagement of these elements is seen in FIGS. 5A and 5B. As there shown, at least predetermined ones of the drive pins 18 include specially configured head ends carrying an upwardly-projecting key 40, while support bridge 26 includes correspondingly arranged and configured keyways 42. Keyways 42 may comprise appropriately configured recesses, or slots extending fully through bridge 26, although in the latter case it is preferred that when the bridge rests atop drive pins 18 keys 40 do not extend upwardly beyond the top face or surface of the support bridge so as to avoid inadvertent puncture of elastic skin 16. In any event, the mutual engagement means of FIGS. 5A and 5B is disclosed by way of example only and any suitable structures effective to maintain the positional relation of bridge 26 to drive pins 18 may be utilized.

In the apparatus 30, selected axial movement of drive pins 18 is effected by way of plural controllers 44, one implementation of which is illustrated in FIG. 6. Controllers 44 are provided in one-to-one relation to drive pins 18, so that the axial movement of each drive pin can be independently directed by the user of apparatus 30. Thus, although not specifically illustrated in the drawings, each controller 44 is connected to a corresponding one of the drive pins 18.

Referring now to FIG. 6, the controller 44 there shown includes a tubular body 46 threaded at its end which projects upwardly through platform 32. An adjustment screw 48 is conformingly threaded for rotative receipt in body 46, and includes a slot 50 defined at its head end for receiving a screwdriver or like adjustment tool. Slot 50 may be replaced by any other adjustment-enabling structure as desired. The use of screws 48 for remotely adjusting the axial movement of drive pins 18 permits relatively precise adjustments of drive pin height to be readily effected. Nevertheless, other, non-rotative arrangements may alternatively be substituted therefor so long as sufficiently accurate pin height adjustment is attainable.

In the illustrated embodiment, each remotely positioned controller 44 is independently operable to selectively regulate the height or projection of a corresponding drive pin 18 above platform surface 32 by the use of hydraulics. Adjustment screw 48 accordingly carries at its end opposite its head a series of pistons 52, and each controller body 46 is connected to the corresponding drive pin 18 by a tube or other hydraulic fluid communication duct. Any conventional arrangement of hydraulic components known to those skilled in the art may be utilized in implementing the hydraulic arrangement, and no details thereof are accordingly depicted. It should, however, be clear that as adjustment screw 48 is rotated with respect to fixed tubular body 46 the axial projection of the corresponding drive pin 18 will correspondingly vary, thereby enabling precision control over the amount of lift or support to be provided by each drive pin in fabricating a custom orthotic.

To facilitate ready use of apparatus 30, it is preferred that controllers 44 be so positioned with respect to each other as to correspondingly map the relative locations of their respective drive pins 18. In other words, it is contemplated that controllers 44 will be arranged in the same matrix configuration as their respective drive pins 18 to thereby facilitate the operator in accurately determining the particular drive pin being adjusted at any given instant.

Moreover, hydraulic driving arrangements are known by which an inward rotation of adjustment screw 48 will cause a corresponding downward axial movement of the corresponding drive pin 18, and vice versa. Such an arrangement provides the additional advantage of enabling the operator to see a positive image of the incipient orthotic contour by viewing the relative positions of the heads of adjustment screws 48.

Although hydraulics are herein suggested for effecting remote control of drive pin movement, numerous alternative arrangements are practical and within the scope and contemplation of the invention. Such alternatives include ball bearings or structures incorporating ball bearings as a substitute for hydraulic fluid, direct cable connection between each drive pin 18 and its corresponding remote controller 44, and electronic servomechanisms or the like, and no limitation is intended by the particular illustrative embodiment herein disclosed.

Various additional modifications to the disclosed apparatus are possible within the scope and spirit of the invention. For example, substrate pad 14 may be omitted so that platform 32 in effect serves as the mold surface defining the bottom of the orthotic to be formed by the molding material injected under foot 12. It is preferred, where pad 14 is omitted, that drive pins 18 be provided along the entire area underlying the foot sole to lift the same fully above platform 32 and thereby facilitate the free flow of molding material under the entire foot. Such an arrangement is particulary appropriate in the fabrication of orthotics for individuals whose feet are, for example, severely supinated such that relatively extreme correction by the orthotics is necessary.

The present invention thus provides an apparatus for custom producing precision orthotics while the individual being fitted remains standing and feet bear full body weight. Orthotic fabrication is completed quickly and on-site directly from the individual's foot, eliminating errors conventionally arising in the preparation of intermediate molds. Significantly, no special skills or training are required to operate the apparatus, so that a properly configured orthotic is produced with each use.

While there have been shown and described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An apparatus for producing orthotics, comprising:

a surface for supporting at least one foot of a person for whom an orthotic is to be produced so that the person is standing and the foot is disposed in load-bearing condition;

a substrate pad disposed atop said surface to define the bottom of the orthotic;

an elastic skin disposed atop said pad to define the upper wall of the orthotic;

boundary wall means on said surface for laterally surrounding the foot and securing the lateral edges of said elastic skin;

an injection port defined in said foot-supporting surface and in said pad through which molding material is injectable into the area between said substrate and skin to thereby form the body of the orthotic therebetween while the foot is supported on said surface in load-bearing condition;

a plurality of elongated pin means portruding through apertures defined in said supporting surface and substrate pad at least in the area of said surface and pad disposed under the arch portion of the foot, each said pin means being arranged for selected independent movement axially along its direction of elongation into contact against the sole of the foot disposed on said apparatus when the foot is properly aligned and positioned in load-bearing condition for production of an orthotic, and said pin means being retractable from the interior of the completed orthotic; and means for positionally fixing said pin means at said contact positions thereof so that, as molding material is injected through said port to form the body of the orthotic and is then permitted to set for retention of the orthotic shape, proper alignment and position of the foot is maintained by said fixed pin means to assure production of an accurately-defined and configured orthotic.

2. An apparatus in accordance with claim 1, further comprising a deformable support bridge disposed between said skin and pad and atop said pin means so that, as the pin means are axially moved toward the foot sole they are brought into contact with said bridge which is correspondingly driven against the foot sole to thereby comprise and define a continuous surface closely conforming to the configuration of that portion of the sole against which the bridge is driven.

3. An apparatus in accordance with which claim 2, said bridge and at least some of said pin means having cooperating means for mutual engagement therebetween to maintain the relative position of said bridge with respect to said pin means during production of the orthotic.

4. An apparatus in accordance with claim 1, further including a plurality of said injection ports through which molding material is injectable into the area between said substrate and skin.

5. An apparatus in accordance with claim 2, said bridge being situate at least in the area disposed under the arch of the foot.

6. An apparatus in accordance with claim 1, further comprising means for remotely controlling the selected axial movement of said pin means, said remote means including a plurality of controllers in one-to-one relation to said plural pin means, each controller being independently adjustable to cause selected axial movement of its corresponding pin means, and connecting means by which an adjustment of each said controller is transmitted to its corresponding pin means to effect a desired axial movement thereof.

7. An apparatus in accordance with claim 6, each said controller including threaded adjustment means for selected rotation by which the height of at least a portion of said controller is varied in corresponding relation to the intended and resulting axial movement of the corresponding pin means.

8. An apparatus in accordance with claim 6, said connecting means comprising hydraulic driving means connecting each said controller and its corresponding pin means.

9. An apparatus for producing orthotics, comprising:

a surface for supporting at least one foot of a person for whom an orthotic is to be produced so that the person is standing and the foot is disposed in load-bearing condition, and comprising the surface along which the bottom of the orthotic is defined during its production;

an elastic skin disposed atop said surface to define the upper wall of the orthotic;

boundary wall means on said surface for laterally surrounding the foot and securing the lateral edges of said elastic skin;

an injection port defined in said foot-supporting surface through which molding material is injectable into the area between said substrate and skin to thereby form the body of the orthotic therebetween while the foot is supported on said surface in load-bearing condition;

a plurality of elongated pin means portruding through apertures defined in said supporting surface at least in the area of said surface disposed under the arch portion of the foot, each said pin means being arranged for selected independent movement axially along its direction of elongation into contact against the sole of the foot disposed on said apparatus when the foot is properly aligned and positioned in load-bearing condition for production of an orthotic, and said pin means being retractable from the interior of the completed orthotic; and means for positionally fixing said pin means at said contact positions thereof so that, as molding material is injected through said port to form the body of the orthotic and is then permitted to set for retention of the orthotic shape, proper alignment and position of the foot is maintained by said fixed pin means to assure production of an accurately-defined and configured orthotic.

10. An apparatus in accordance with claim 9, further comprising a deformable support bridge disposed between said skin and supporting surface and atop said pin means so that, as the pin means are axially moved toward the foot sole they are brought into contact with said bridge which is correspondingly driven against the foot sole to thereby comprise and define a continuous surface closely conforming to the configuration of that portion of the sole against which the bridge is driven.

11. An apparatus in accordance with which claim 10, said bridge and at least some of said pin means having cooperating means for mutual engagement therebetween to maintain the relative position of said bridge with respect to said pin means during production of the orthotic.

12. An apparatus in accordance with claim 9, further including a plurality of said injection ports through which molding material is injectable into the area between said substrate and skin.

13. An apparatus in accordance with claim 10, said bridge being situate at least in the area disposed under the arch of the foot.

14. An apparatus in accordance with claim 9, further comprising means for remotely controlling the selected axial movement of said pin means, said remote means including a plurality of controllers in one-to-one relation to said plural pin means, each controlnt thereof.

15. An apparatus in accordance with claim 14, each said controller including threaded adjustment means for selected rotation by which the height of at least a portion of said controller is varied in corresponding relation to the intended and resulting axial movement of the corresponding pin means.

16. An apparatus in accordance with claim 14, said connecting means comprising hydraulic driving means connecting each said controller and its corresponding pin means.

* * * * *